US005743393A

United States Patent [19]

Webb et al.

[11] Patent Number: 5,743,393

[45] Date of Patent: Apr. 28, 1998

[54] PROTECTIVE PACKAGE FOR HEAVY OBJECTS

[76] Inventors: H. Richard Webb, 14687 Los Padres, Chesterfield, Mo. 63017; Peter H. Webb, 1108 E. Third St., Washington, Mo. 63090

[21] Appl. No.: 851,671

[22] Filed: May 6, 1997

[51] Int. Cl.[6] ..... B65D 85/68

[52] U.S. Cl. ..... 206/319; 206/590; 206/594

[58] Field of Search ..... 206/319, 320, 206/587, 588, 589, 590, 591, 592, 593, 594

[56] References Cited

U.S. PATENT DOCUMENTS

| | | | |
|---|---|---|---|
| 4,792,043 | 12/1988 | Holladay | 206/587 |
| 5,361,900 | 11/1994 | Stringer et al. | 206/319 |
| 5,590,786 | 1/1997 | Jaycox | 206/587 |

*Primary Examiner*—Jacob K. Ackun

*Attorney, Agent, or Firm*—Polster, Lieder, Woodruff & Lucchesi, L.C.

[57] ABSTRACT

A package for storing and shipping a heavy object, such as a compressor for an air-conditioning system, includes a base formed from a rigid material and having recesses which receive feet at the bottom of the object and flaps which fold over the recesses and capture the feet in them, thus securing the object to the base. The package also includes a box having side walls and top and bottom walls. The base, with the object secured to it, fits into the box with the base against the bottom wall of the box and the object surrounded by the side walls of the box. A sleeve fits into the box between the base and the top wall and holds the base against the bottom wall. A tray fits within the sleeve above the object where it rigidifies the sleeve, enabling the sleeve to maintain its cross-sectional configuration, and further serves as a receptacle for accessory items.

18 Claims, 4 Drawing Sheets

PROTECTIVE PACKAGE FOR HEAVY OBJECTS

BACKGROUND OF THE INVENTION

This invention relates in general to packaging and more particularly to a protective package for heavy objects.

Some manufactured products, which function as components of other manufactured products occupy relatively little space, yet are quite heavy. When sold to manufacturers of original equipment, these component products are traditionally shipped in bulk containers designed to accommodate them. But a significant aftermarket exists for these component products as well, and when sold in the aftermarket, these component products require individual packaging. Compressors for residential and light commercial air-conditioning systems represent a typical component product. They are manufactured separately from the condenser units in which they are ultimately installed and indeed represent one of three major components in such units, the others being the condenser coil and the fan which draws air across the coil. And while the compressor occupies relatively little space, it is quite heavy, generally weighing from 50 to 100 pounds.

The typical compressor has a hermetically sealed shell which contains the actual compressor mechanism and an electric motor for driving it. The shell is attached to a stamped metal base having laterally directed feet. When sold for the aftermarket the compressor is often furnished in a corrugated paperboard box. However, corrugated paperboard will not support a heavy compressor without considerable reinforcement. In traditional packaging, that reinforcement resides primarily in a base on which the compressor rests. Typically, the base is formed from plastic or plywood or oriented strand board (OSB).

Packaging for a compressor must pass rigorous tests before compressor manufacturers will accept it. One of the tests involves dropping the package with the heavy compressor in it from a height of one foot ten times such that the package lands on a different corner and exterior panel on each drop, all without inflicting damage on the compressor. Packages containing plastic bases have not fared well in these tests. Plywood and oriented strand board bases, on the other hand, are expensive and time consuming to assemble (e.g., nuts, bolts and washers for fasteners).

Other packaging contains large quantities of cushioning formed from expanded plastic (plastic foam). This material contains chemicals which the State of California had found to cause cancer, birth defects or other reproductive harm and does not degrade in land fills, as does the corrugated paperboard, and is not desirable from that standpoint.

BRIEF SUMMARY OF THE INVENTION

The present invention resides in a package including a box, a rigid base on which a packaged object rests within the box, and a spacer which extends from the base to the top of the box to hold the base against the bottom of the box. The package base has a depression in which lateral extensions on the packaged object fit and also retaining members which lie over the extensions on the object to secure the object to the base. Being formed from paper, the package readily degrades in land fills, but it may be recycled. The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to like parts wherever they occur.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what is presently believed to be the best mode of carrying out the invention.

Figure 1:
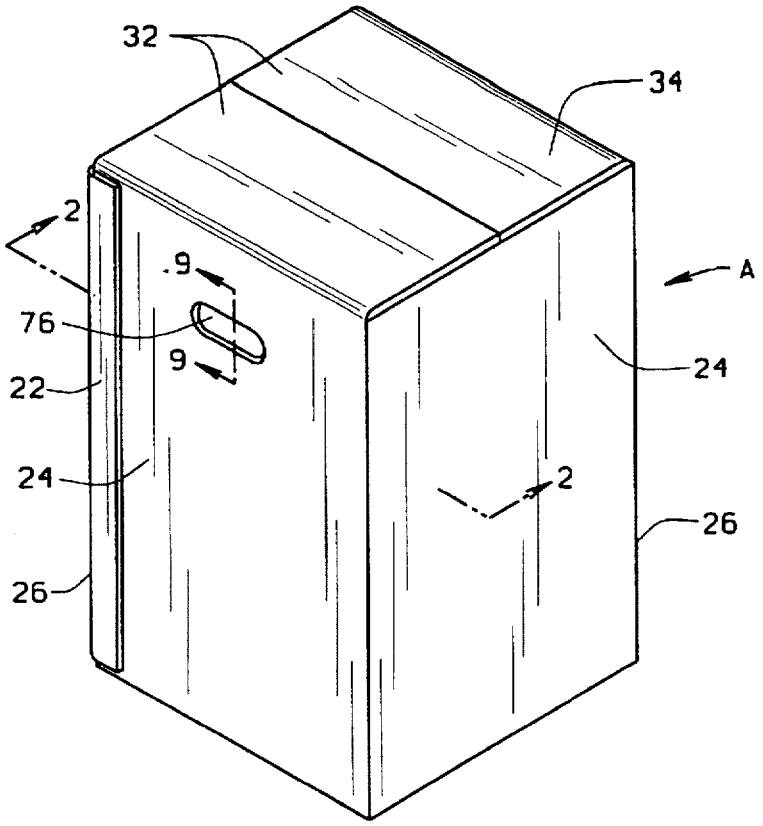
FIG. 1 is a perspective view of a package constructed in accordance with and embodying the present invention.

Referring now to the drawings, a package A (FIGS. 1–3) contains a heavy, yet compact object, which here takes the form of a compressor B for a condenser unit suited for use in residential or light commercial air-conditioning systems. The compressor B includes a steel shell 2 formed from parts which are joined together to encase all of the working components of the compressor B, thus forming a hermetically sealed unit. The shell 2 is attached to a base 4 having lateral extensions in the form of feet 6 which project beyond the shell 2. In the typical condenser unit the feet 6 of the base 4 rest on springs or rubber grommets that in turn rest on housing for the unit where they are held in place with bolts, all enabling the compressor B to operate without imparting excessive vibrations to the housing. The compressor B also has electrical components mounted on its shell 2, and wires which pass through the shell 2. It also has copper tubes that emerge from its shell 2 for receiving and discharging a refrigerant.

The package A totally encloses the compressor B. It includes (FIG. 3) a box 12 of the typical six-sided configuration, a generally rigid base 14 which fits into the box 12 and actually supports the compressor B, a sleeve 16 which fits around the compressor B and extends from the base 14 to the top of the box 12, and a tray 18 which fits into the sleeve 16 and generally against the top of the compressor B. The package A confines the compressor B both vertically and laterally such that the shell 2 of the compressor B is spaced from the sides of the box 12. Moreover, it will accommodate compressors B of different heights.

The box 12 derives from a blank cut from double wall corrugated paperboard which consists of three essentially flat sheets and two corrugated sheets interposed between the flat sheets. Actually, the blank is folded into a tubular configuration, in which it is retained by a manufacturer's joint 22. When the box 12 is so folded, it may reside in a knocked-down configuration, but is easily erected from that configuration, that is converted into a configuration suitable for receiving the base 14, the sleeve 16 and the tray 18 and of course the compressor B. When erected, the box 12 has (FIGS. 1–3) four side walls 24 of equal width which are joined together at right angle corners 26. The manufacturer's joint 22 exists along one of the corners 26 between two of the side walls 24. Along their bottom margins, the four side walls 24 are connected to flaps 28 which are folded inwardly and over each other and then stapled together to form a bottom wall 30. Each of the side walls 24 along its top margin has another flap 32 attached to it, but the flaps 32 are initially detached from each other to provide access to the interior of the box 12. Once the box 12 is loaded with the base 14, to which the compressor B attached, and with the sleeve 16 and the tray 18, the flaps 32 are folded over onto each other and stapled together to form a top wall 34 at the other end of the box 12.

The base 14 is quite rigid, with its dimensions being such that it fits into the interior of the box 12 with essentially no lateral free motion. In essence, its side edges are as long as the side walls 24 of the box 12 are wide. Preferably, the base 14 is formed of corrugated paperboard which is layered, cut into panels of the desired thickness, with the corrugations extending between its major surface areas, and then provided with facer sheets over those major surfaces. This produces a rigid slab like material, yet one that is light in weight. The slab material will readily degrade in landfills and thus is disposable without harm to the environment or it may be recycled. More specifically, the rigid material of the base 14 includes (FIGS. 6–8) alternating layers 36 of flat paper and layers 38 of corrugated paper. The corrugated layers 38 lie between the flat layers 36 and are joined to the flat layers 36 along the ridges of the corrugations. The structure so formed possesses considerable compressive strength in the direction of its corrugations, that is to say, parallel to the ridges and valleys of the corrugated layers 38. The slab-like material also has facer sheets 40 extended over the end edges of the alternating flat and corrugated layers 36 and 38, and indeed the facer sheets 40 are attached to the layers 36 and 38 with glue. The thickness of the facer sheets 40 exceeds the thickness of the paper in the flat and corrugated layers 36 and 38. The slab-like material for the base 14 is available from North American Container Corporation of Smyrna, Ga., which sells it under the trademark FIBRE/CORE.

Figure 4:
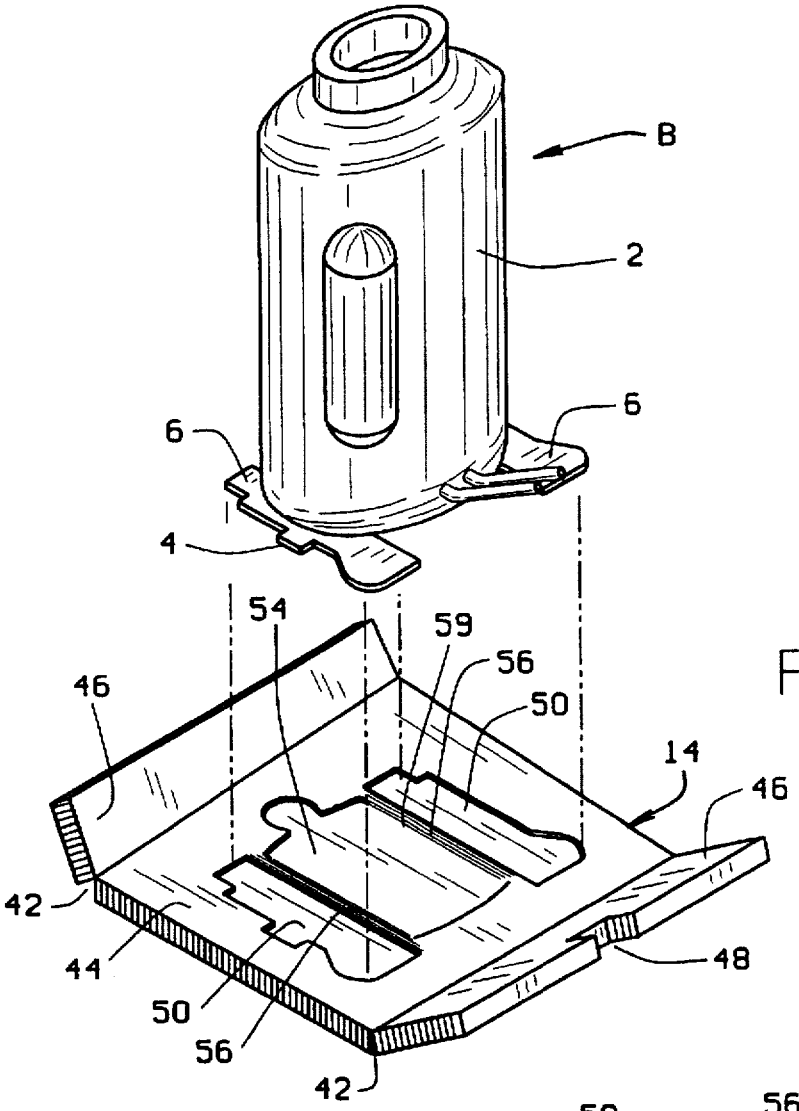
FIG. 4 is an exploded perspective view showing the package base open to receive the base of the packaged object.
Figure 7:
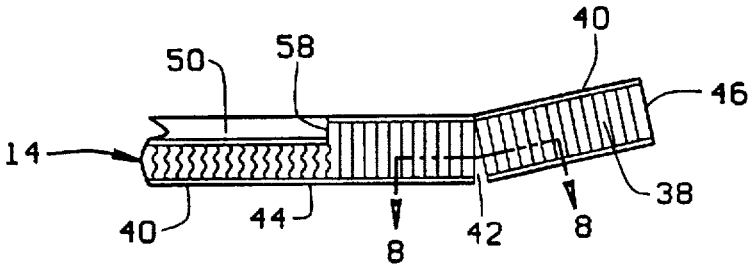
FIG. 7 is a is a sectional view taken along line 7—7 of FIG. 5.
Figure 8:
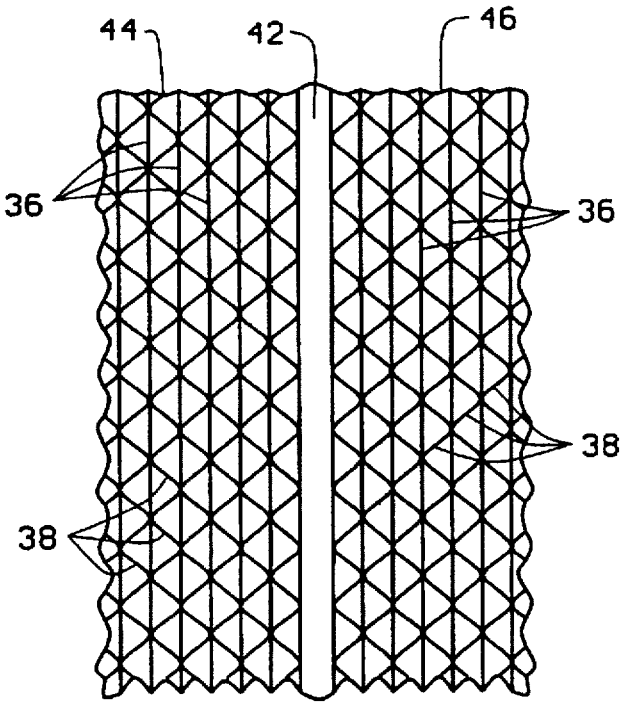
FIG. 8 is a sectional view taken along line 8—8 of FIG. 7 and showing the corrugations in the package base.

Actually, the slab of rigid material from which the package base 14 is formed is initially longer than the space between opposite side walls 24 in the box 12 (FIG. 5), but the slab is cut through its bottom facer sheets 40 and overlying corrugations, although not the upper facer-sheets 40, to provide two slits 42, the spacing between which corresponds to the spacing between opposite side walls 24 in the box 12 (FIGS. 4 & 7). The slits 42 divide the base 14 into a main panel 44 and two flaps 46 which fold at the slits 42 and lie over the main panel 44. Indeed, the upper facer sheet 40, which remains intact across the slits 42, serves as a hinge for connecting the flaps 46 to the main panel 44. One of the flaps 46 contains a notch 48 which opens out of that margin that lies parallel to the slit 42 that separates the flap 46 from the main panel 44.

The main panel 44 contains (FIGS. 4 & 5) two lateral depressions 50 and an intermediate depression 54 located between the lateral depressions 50. Between the intermediate depression 54 and each of the lateral depressions 50 extends a rib 56 which lies slightly below those regions of the upper facer sheet 40 that are beyond the depressions 50 and 54. The lateral depressions 50 are configured to receive the base 4 of the compressor B with the feet 6 on the base 4 extended to the ends of the depressions 50. The intermediate depression 54, on the other hand, is configured to receive the underside of the shell 2 between the two sections of the base 4 and also an electrical component that lies near the bottom of the shell 2.

Figure 5:
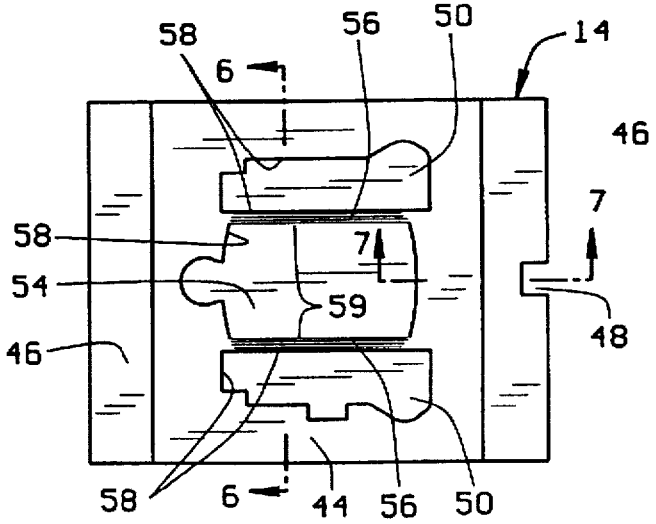
FIG. 5 is a plan view of the package base with its flap open.
Figure 6:
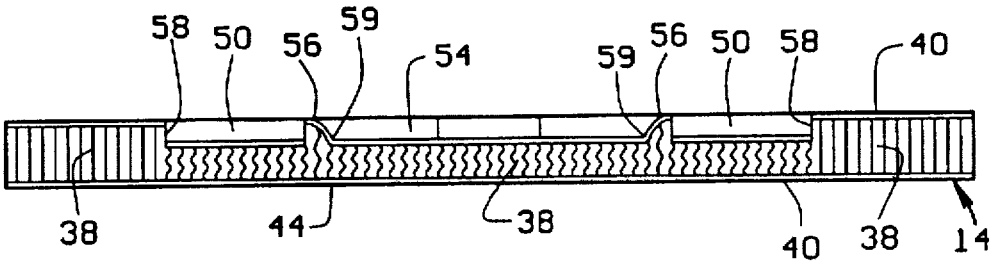
FIG. 6 is a sectional view taken along line 6—6 of FIG. 5.

Each of the lateral depressions 50 is completely surrounded by a cut 58 in the upper facer sheet 40 of base 14 (FIGS. 4 & 5). The intermediate depression 54, on the other hand, has cuts 58 only along its margins that extend generally between the lateral depressions 50, that is between the ends of the ribs 56. Along the ribs 56 the intermediate depression 54 is bordered by scores 59. Once the cuts 58 are formed in the upper facer sheet 40, the regions delineated by the cuts 58 are depressed to depth between 5/16 and 7/16 inches before rebound. This crushes the flat and corrugated layers 36 and 38 underlying the regions delineated by the cuts 58 and creates the depressions 50 and 54 and also the scores 59 along the ribs 56. Here the compression is such that the upper facer sheet 40 possesses a slight bevel where it undergoes a change in elevation between the bottom of the depression 54 and the tops of the ribs 56 (FIG. 6). Thus, the sides of the intermediate depression 54 are beveled, and this imparts strength to the ribs 56 in the lateral direction.

The flaps 46, when folded over onto the main panel 44, overlie the ends of the two lateral depressions 50. But before the flaps 46 are folded, the compressor B is placed on the base 14 with its base 4 in the lateral depressions 50—indeed, with its feet 6 extended outwardly to the ends of the depressions 50. The underside of the shell 2, on the other hand, lies within the intermediate depression 54. Once the compressor B is placed on the base 14, the flaps 46 are folded over onto the main panel 44 of the base 14 (FIGS. 2 & 3) and indeed are secured to the main panel 44 with staples. The staples pass all the way through the flaps 46 and the main panel 44 and are cinched beneath the main panel 44. In the alternative, a hot melt adhesive may be used to secure the overlapping flaps 46 to each other. With the flaps 46 so folded and secured, their extended free edges lie along the sides of the shell 2. The flaps 46 themselves lie over the feet 6 on the base 4 of the compressor B, and thus capture the base 4 of the compressor B in the base 14 of the package A. The notch 48 in the one flap 46 accommodates copper tubes that emerge from the shell 2 of the compressor B.

The compressor B and base 14 are then lowered as a unit into the box 12 until the base 14 comes to rest on the bottom wall 30 of the box 14. The shell 2 of the compressor B extends upwardly through the interior of the box 12 with ample space between it and the side walls 24 of the box 12. The base 14 of the package A, by reason of its capture of the base 4 of the compressor B, prevents the compressor B from shifting laterally in the box 12.

Like the box 12, the sleeve 16 is formed from double wall corrugated paperboard. Initially, it exists as a blank, but it is folded into a tubular configuration and maintained in that configuration by a manufacturer's joint 60. The sleeve 16 contains (FIG. 3) four side walls 62 which are joined together at right angle corners 64, one of which exists along the manufacturer's joint 60. Each side wall 62 is wider than the shell 2 and opposite side walls 62 are equal in width so that the sleeve 16, when its corners 64 are at right angles, possesses a rectangular configuration. The walls 62 are just wide enough to enable the sleeve 16 to pass easily over the shell 2 and any components that may project laterally from the shell 2, with little space between the sleeve 16, on one hand, and the shell 2, on the other hand. The sleeve 16, of course, fits within the box 12 where it surrounds the shell 2 of the compressor B, with its side walls 62 lying parallel to, yet spaced inwardly from, the side walls 24 of the box 12. Two of the side walls 62 on the sleeve 16 along their lower margins have tabs 66 which project downwardly a distance no greater than the thickness of the flaps 46 on the package base 14. The width of each tab 66 is about equal to the spacing between the folded over flaps 46 on the package base 14. Indeed, when the sleeve 16 is fitted over shell 2 of the compressor B, the tabs 66 align with and fit into the space between the folded over flaps 46. This stabilizes the lower end of the sleeve 16 in the sense that it prevents the sleeve 16 from shifting laterally over the flaps 46, and further prevents the sleeve 16 from rotating around the compressor shell 2.

Figure 2:
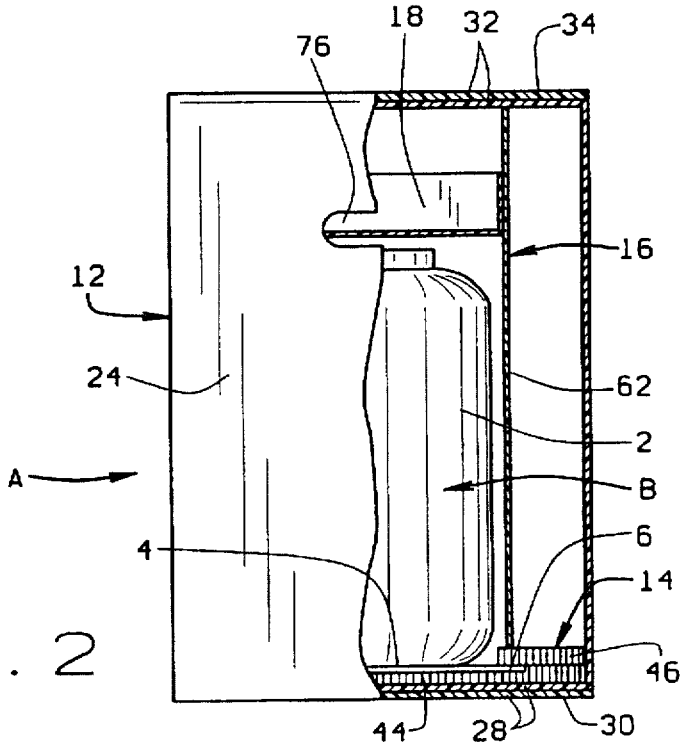
FIG. 2 is a partial sectional view of the package taken along line 2—2 of FIG. 1 and showing a packaged object in the package.
Figure 3:
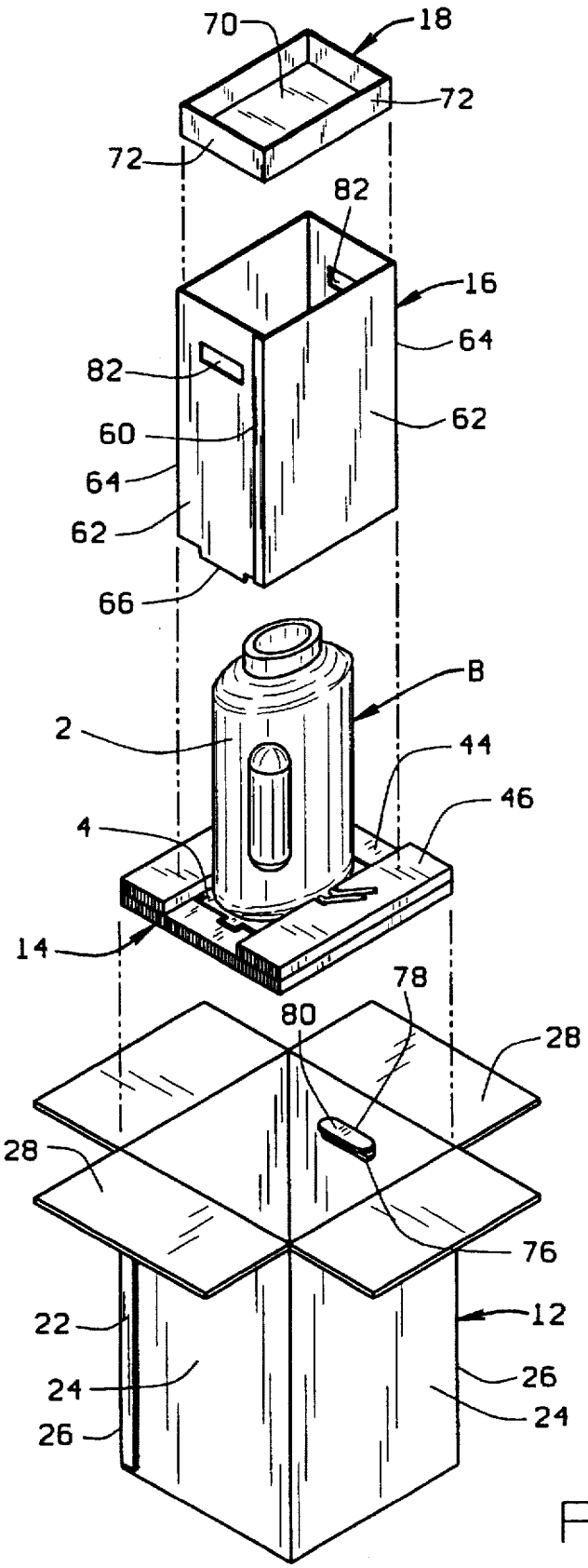
FIG. 3 is an exploded perspective view of the package and likewise showing the packaged object.

The flaps 32 at the upper end of the box 12 ultimately fold over onto the upper margins of the side walls 62 for the sleeve 16 and from the top wall 34 of the box 12 (FIG. 2). The sleeve 16 thus lies captured between the package base 14 and the top wall 34 of the box 12, and as such prevents the package base 14 from moving away from the bottom wall 30 of the package 12.

However, before the upper flaps 32 are folded over to form the top wall 34 of the box 12, the tray 18 is inserted into the upper end of the sleeve 16—indeed to the extent that it lies immediately over the top of the shell 2 of the compressor B (FIG. 2). The tray 18 consists of (FIG. 3) a rectangular bottom panel 70 and four side panels 72 which are connected to the bottom panel 70 along the four margins that border that panel. The bottom panel 70 corresponds in size and configuration to the space enclosed by the sleeve 16, so when the tray 18 is inserted into the sleeve 16, the bottom panel 70 extends across the full interior of the sleeve 16.

The side panels 72 of the tray 18, on the other hand, lie along the inside faces of the side walls 62 of the sleeve 16. The tray 18 is lowered through the sleeve 16 until its bottom panel 70 lies immediately above the upper surface of the shell 2 on the compressor B (FIG. 2). When the tray 18 is so positioned, staples are driven through the side panels 72 of the tray 18 and the side walls 62 of the sleeve 16, thus securing the tray 18 firmly in position within the sleeve 16.

The tray 18 serves to rigidify the sleeve 16 and maintain it in a tubular configuration with its corners 64 at 90°. The tray 18 also serves as a receptacle for accessories and instructional material that are shipped with the compressor B. The tray 18 can assume a multitude of positions within the sleeve 16 and as a consequence the package A can accommodate compressors B having shells 2 of varying heights.

Once the tray 18 is stapled to the sleeve 16 and loaded with instructional materials and accessories, the top flaps 32 at the upper ends of the side walls 24 for the box 12 are folded over onto the upper margins of the sleeve 16, with the flaps 32 from two of the side walls 24 overlying the flaps from the other two side walls 24 (FIG. 2). The overlying flaps 32 are then stapled together to form and secure the top wall 34 of the box 12.

The sleeve 16 lies captured between the top wall 34 and the package base 14 which is against the bottom wall 30, and hence neither the sleeve 16 nor the package base 14 can shift vertically in the box 12. The base 4 of the compressor B lies captured between the main panel 44 and flaps 46 of the package base 14, while the bottom panel 70 of the tray 18 lies directly over the upper end of the shell 2 for the compressor B. This prevents the compressor B from shifting vertically in the box 12. Apart from that, the sleeve 16 imparts greater column strength to the package A so that multiple packages A may be stacked, one upon the other.

Since the feet 6 on the base 4 of the compressor B fit into the lateral depressions 50 of the package base 14 and cannot rise out of those depressions 50, the compressor B is also confined laterally within the package A. In this regard, the package base 14, being formed from densely packed flat layers 36 and corrugated layers 38, possesses considerable strength, both vertically and laterally, and does not yield along the margins of the depressions 50, notwithstanding the considerable weight of the compressor B.

The package A protects the compressor B and further enables multiple compressors B to be stored, one over the other and side-by-side, in an orderly manner. Moreover, the box 12 is easily handled and moved about. Thus, the package A facilitates handling, storage and transport of the compressors B.

Figure 9:
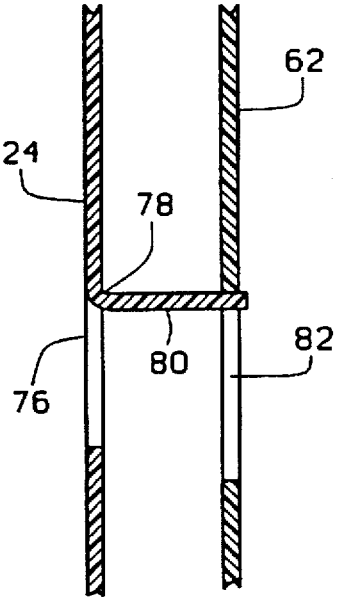
FIG. 9 is a sectional view taken along line 9—9 of FIG. 1 and showing the flap for providing a convenient hand grip.

To facilitate handling of the package A, it may be provided with hand grips. To this end two of the side walls 24 on opposite sides of the box 12 are provided with elongated cutouts 76 (FIG. 1), the major axes of which extend horizontally parallel to the bottom and top walls 30, 34. Moreover, the height of each cutout 76 is slightly greater than the spacing between the side wall 24 in which the cutout 76 exists and that side wall 62 of the sleeve 16 which lies immediately inwardly from it. The cutout 76 is not a continuous cut, but instead along its upper margin is defined by a score 78. Here a flap 80 (FIG. 9) in the shape of the cutout 76 is attached to the side wall 24, and it folds inwardly into the box 12. Indeed, the flap 80 extends all the way to the facing side wall 62 of the sleeve 16 which has an aperture 82 to receive it. The upper margin of the aperture 82 in the sleeve 16 extends horizontally and lies at the same elevation in the box 12 as the score 78 along which the flap 80 is attached to the side wall 24 of the box 12. Thus, the flap 80, when deflected fully into the interior of the box 12, will assume a horizontal orientation against the upper edge of the aperture 82 in the sleeve 16. This provides a comfortable surface against which one can lift the package A which is of considerable weight owing to the presence of the compressor B in it.

The package A will, of course, accommodate other heavy objects having bases that fit depressions in the package base.

As various changes could be made in the above constructions without departing from the scope of the invention, it is intended that all matter contained in the above description or shown in the accompanying drawings shall be interpreted as illustrative and not in a limiting sense.

What is claimed is:

1. A package comprising: a box having side walls located around an interior, a bottom wall at the lower end of the side walls and generally closing the interior at its lower end, and a top wall at the upper end of the side walls and generally closing the interior at its upper end; a base located within the interior of the box along its bottom wall, the base having a main panel that is formed from a generally rigid material and has depressions which open upwardly out of it, the base further having retaining members which extend partially over the depressions, so as to hold a packaged object in the depressions; and a spacer member extended between the base and the top wall and preventing the base from moving away from the bottom wall of the box.

2. A package according to claim 1 wherein the retaining members are connected to the main panel of the base such that they will fold with respect to the main panel when not otherwise restrained.

3. A package according to claim 2 wherein the retaining members are formed from the same generally rigid material as the main panel.

4. A package according to claim 3 wherein the main panel of the base has edges that lie along all of the side walls of the box so that the base is confined laterally by the side walls of the box.

5. A package according to claim 3 wherein the base is formed from layers of corrugated paper joined together such that the corrugations lie generally perpendicular to the bottom wall of the box and from upper and lower facer sheets which extend across and are attached to the end edges of the corrugated paper, the facer sheets lying generally parallel to the bottom wall of the box.

6. A package according to claim 5 wherein the upper facer sheet of the base is cut along at least some of the margins of the depressions and the corrugated paper underlying the depressions is crushed.

7. A package according to claim 6 wherein the main panel of the base has adjacent depressions and a narrow rib separating the depressions; and wherein the upper facer sheet is cut along one side of the rib and beveled along the other side of the rib, whereby the bevel keeps the facer sheet intact and prevents the rib from displacing laterally.

8. A package according to claim 1 wherein the spacer member is a sleeve having side walls which are joined together and spaced from the side walls of the box.

9. A package according to claim 8 wherein the side walls of the sleeve extend over the retaining members of the base, and at least one of the side walls has a tab which projects past the retaining member toward the main panel of the base.

10. A package according to claim 8 wherein the base has two retaining members which are spaced apart, and the sleeve has tabs which project into the space between the retaining members.

11. A package according to claim 8 and further comprising a tray located in and secured to the sleeve above the base to maintain the sleeve in a fixed cross-sectional configuration and to serve as a receptacle.

12. A package according to claim 8 wherein at least one of the side walls of the package has a hand opening and a flap which projects inwardly toward the sleeve along the upper margin of the hand opening and engages the sleeve to provide a substantially horizontal surface against which one may apply a manual lifting force to the package.

13. In combination with a product having laterally directed extensions at its lower end, a package for enclosing the product to facilitate storage, shipping and handling of the product, said package comprising: a base having a main panel provided with upwardly opening recesses in which the laterally directed extensions of the product fit, so that the product is supported on the base, the base further having flaps which are attached to the main panel of the base such that they fold with respect to the main panel, the flaps being folded over the recesses and over the extensions within the recesses and secured to the main panel of the base, whereby the product is secured to the base; a box enclosing the base and the product, the box including a bottom wall on which the base rests, side walls attached to the bottom wall and extending upwardly from it to surround the product, and a top wall attached to the upper ends of the side walls and extended over the product, whereby the product is fully enclosed in the box; and a sleeve surrounding the product and extending between the base and the top wall of the box.

14. The combination according to claim 13 wherein the base is formed from layers of corrugated paper arranged with the corrugations directed vertically and upper and lower facer sheets attached to the layers of corrugated paper at their end edges, the recess being bordered at least in part by cuts in the upper facer sheet, the corrugated layers being crushed beneath the recess.

15. The combination according to claim 14 wherein the lower facer sheet and corrugated layers at the sides of the main panel of the base are cut to provide the flaps which are attached to the main panel along the upper facer sheet where they fold with respect to the main panel.

16. The combination according to claim 14 wherein the flaps are spaced apart so that a region of the main panel of the base is exposed between flaps; and wherein the sleeve has tabs which project into the space between the flaps on the base.

17. The combination according to claim 14 and further comprising a tray located within the sleeve above the object to rigidify the sleeve such that it retains its cross-sectional configuration.

18. A package according to claim 14 wherein at least one of the side walls of the package has a hand opening and a flap which projects inwardly toward the sleeve along the upper margin of the hand opening and engages the sleeve to provide a horizontal surface against which one may apply a manual lifting force.

* * * * *